United States Patent [19]

Guilliams

[11] 4,318,316

[45] Mar. 9, 1982

[54] LOCKING PLIERS FOR GRIPPING THREADED HANGER RODS

[76] Inventor: Charles M. Guilliams, 404 Ward St., Paducah, Ky. 42001

[21] Appl. No.: 84,074

[22] Filed: Oct. 12, 1979

[51] Int. Cl.[3] ..... B25B 7/02

[52] U.S. Cl. ..... 81/425 A; 81/367

[58] Field of Search ..... 81/418, 421, 422, 423, 81/425 R, 425 A, 5.1 R, 367–380; 269/257; 408/221

[56] References Cited

U.S. PATENT DOCUMENTS

| | | | |
|---|---|---|---|
| 256,525 | 4/1882 | Whiting . | |
| 427,127 | 5/1890 | Spencer | 81/420 |
| 651,082 | 6/1900 | McClary | 81/423 |
| 1,521,647 | 1/1925 | Perry | 408/215 |
| 1,892,082 | 12/1932 | Shekerjian | 81/423 |
| 2,079,505 | 5/1936 | Hopkins . | |
| 2,641,149 | 6/1951 | Petersen . | |
| 2,814,222 | 11/1957 | Sanders | 81/423 |
| 3,042,696 | 10/1962 | Wayne . | |
| 3,107,424 | 10/1963 | Stackawicz | 81/5.1 R |
| 3,199,721 | 7/1963 | Williams . | |
| 3,496,808 | 2/1970 | Schmidt | 81/370 |
| 3,672,245 | 6/1972 | Hoffman | 81/41 X |

*Primary Examiner*—James L. Jones, Jr.

*Attorney, Agent, or Firm*—Berman, Aisenberg & Platt

[57] ABSTRACT

The tool of the present invention comprises a pair of locking pliers with jaws specifically designed to include a threaded cavity complementing a threaded hanger rod, so that the jaws may be quickly closed and locked to grip the rod and support an object to be hund thereon until a permanent threaded support nut can be threaded on the rod and run up to the support position. In one version of the invention, the threaded cavity is formed in a pair of adapter inserts, so that different pairs of inserts may be interchangeably received and held in the plier jaws, which are thus adapted to grip threaded hanger rods of different size and different threads.

4 Claims, 9 Drawing Figures

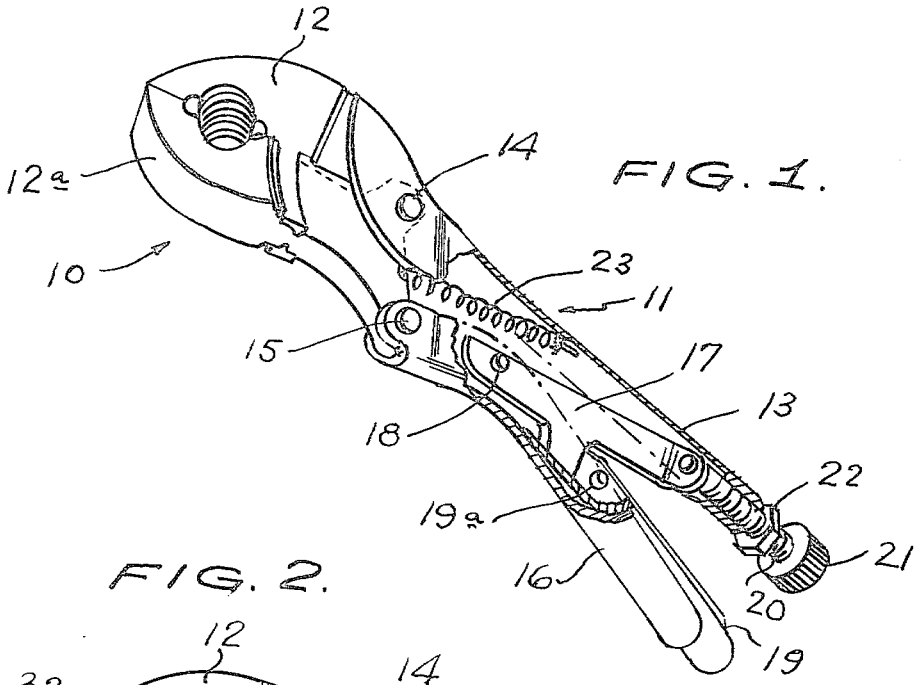
FIG. 1.
FIG. 2.
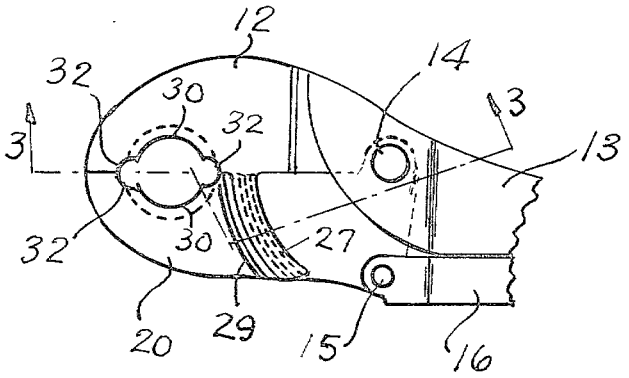
FIG. 4.
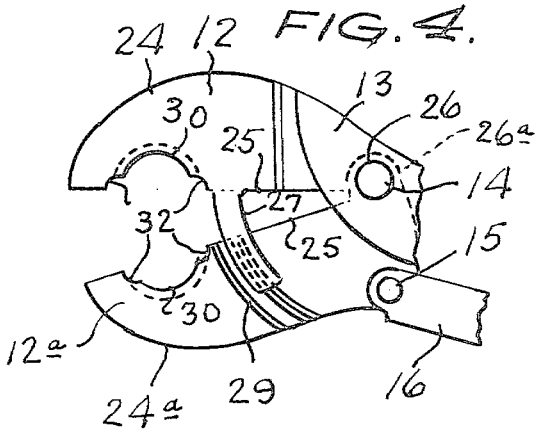
FIG. 3.
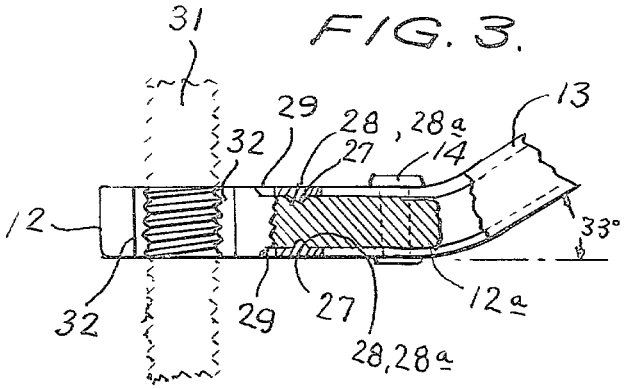

LOCKING PLIERS FOR GRIPPING THREADED HANGER RODS

FIELD OF THE INVENTION

The invention relates to pliers of the locking type, and more particularly to a pair of locking pliers having jaws specifically designed to include a threaded cavity for closely fitting about and gripping a threaded hanger rod, or the like.

In erecting, hanging, assembling or supporting apparatus, machines or materials, threaded hangers, fasteners, rods, or like supports are often used. In such instances, a problem often arises due to damaged threads on the hanger such that the threaded nut to be applied to the hanger cannot be easily started on the end of the hanger rod and "run up" to the required support position. When this occurs it is necessary for the installer, and/or his helpers to support the object or material to be hung while the thread damage is repaired and the permanent, threaded, support nuts started and "run up" to the support position. When the installer is alone without help, it is extremely difficult to support the apparatus, or material, and repair the hanger threads simultaneously, and frequently the apparatus is dropped with resultant damage thereto and even injury to the installer. It is better to lower the apparatus or material to be supported, and substitute a new hanger rod or make the repairs, but this is time consuming and costly.

SUMMARY OF THE INVENTION

The above briefly described problem is overcome by the present invention which provides a pair of pliers of the locking type which can be quickly applied to and locked about the threaded hanger rod, bolt, or stud at approximately the desired support position, thus holding the apparatus or material to be supported, and leaving the installer free to repair the hanger rod threads and to thread on and "run up" the permanent, threaded support nut.

The tool of the present invention comprises a pair of locking pliers of the type disclosed in U.S. Pat. Nos. 2,280,005, 2,514,130, 2,641,149, or 3,842,696 with the jaws modified to include a cylindrical, threaded cavity sized and shaped to complement and accept the threads of the particular hanger rod, bolt or stud involved, so that the tool may be quickly applied at the support position to grip and lockingly clamp the hanger rod. Alternatively, the tool may be applied at a lower position, but above the level of damaged threads, and "run up" to the support position by turning the locked pliers. The same, or another, pair of pliers may be turned to run up or down the hanger rod so as to "dress" or repair damaged threads. The jaws of the pliers may be formed of suitable material to even cut or form new threads on a smooth hanger rod.

From the above, it will be apparent that it is a major object of the invention to provide an improved tool of the locking pliers type in which the jaws are provided with a pair of transverse, threaded recesses which, when the jaws are closed, meet to form a cylindrical threaded cavity capable of quickly gripping a threaded hanger rod at a desired apparatus or material support position.

A further important object of the invention is to provide an improved tool of the locking pliers type, having the above described characteristics, which once clamped and locked about a threaded hanger rod may be turned to move up or down to change the support position, to dress damaged threads on the rod, or to cut new threads on the rod.

Another important object of the invention is to provide an improved tool, having the above described characteristics, in which the threaded cavity in the jaws includes one or more flutes or passage ways for reception and passage out of the tool of chips, or the like, evolved from dressing damaged threads or cutting new threads.

Still another important object of the invention is to provide an improved tool, having the above described characteristics, in which the handles are angled with respect to the plane of the jaws to yield clearance for the hand of the user in applying and locking the tool or in turning the tool with respect to the hanger rod once clamped thereabout.

Yet another object of the invention is to provide an improved tool, having the above described characteristics, in which the jaws are provided with a pair of guides which maintain them aligned in the same plane while turning to open and closed condition so as to retain the threads of the recesses in proper alignment to close upon and grip a threaded hanger rod; said guides being shaped to provide minimum contact area and minimum friction.

A still further object of the invention is to provide an improved tool, having the above-described characteristics, in which the threaded recesses of the jaws are formed in removable and interchangeable adapter inserts so that the pliers are adapted to clamp hanger rods of different size and different threads.

BRIEF DESCRIPTION OF THE DRAWINGS

The novel features that are considered characteristic of the invention are set forth with particularity in the appended claims. The invention itself, however, both as to its organisation and its method of operation, together with additional objects and advantages thereof, will best be understood from the following description of a specific embodiment, when read in connection with the accompanying drawings, wherein like reference characters indicate like parts throughout the several Figures, and in which:

FIG. 1 is a perspective view of the tool of this invention shown with its jaws closed;

FIG. 2 is a side elevation of the jaws of the tool and their connections to fragmentary forward portions of the handle;

FIG. 3 is a sectional view taken along line 3—3 of FIG. 2 and looking in the direction of the arrows; the jaws being clamped about a threaded hanger rod shown in broken lines;

FIG. 4 is a side elevation similar to FIG. 2 but showing the jaws in open condition.

DESCRIPTION OF THE PREFERRED EMBODIMENTS

Figure 5:
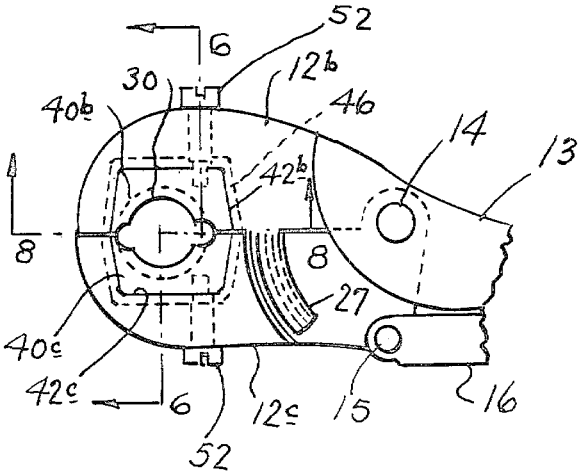
FIG. 5 is a side elevation similar to FIG. 2 but showing a modified tool having interchangeable adapter inserts which enable the pliers to grip various hangers of different rod size and thread size.

Referring now to the drawings, and more particularly to FIG. 1, the tool of the invention is shown, generally identified by the numeral 10, as comprising locking pliers 11 with modified and improved jaws 12, 12*a*.

The locking pliers 11 are of the type described in U.S. Pat. Nos. 2,280,005 and 2,514,130. The pliers 11 generally comprise a first handle 13 of channel cross section having the modified jaw 12 preferably fixedly mounted at its forward end. The second modified jaw 12*a* is pivoted by hinge rivet 14 to the first handle and rear portion of jaw 12. A second handle 16, also of channel cross section, is pivoted to the rearwardmost lower portion of jaw 12*a* by the rivet 15. A connecting toggle link 17 is pivoted at its forward end by rivet 18 to jaw 12*a* and the second handle 16 rearwardly of pivot 15. The rear end of toggle link 17 is slideably engaged in the first handle 13. A releasing lever 19 is disposed rectilinearly in the second handle 16 and is pivotally connected to the toggle link 17 rearwardly of the second jaw 12*a*. The toggle link 17 is disposed at an oblique angle to the longitudinal axes of the handles 13, 16, and includes an angularly disposed portion which may continuously contact the inner surface of the second handle 16 when the second handle is in closed condition parallel to the first handle 13. The point at which the second jaw 12*a* approaches contact with and is locked against the first jaw 12 may be adjusted by turning the head 21 of a threaded rod 20 engaged in threads at the rear of first handle 13, and whose inner end engages the rear end of toggle link 17. The nut 22, on rod 20 inwardly of its head, serves to lock the toggle mechanism and maintain locking tension. Spring force to retain the locking pliers in their respective open and closed positions is provided by a coil spring 23 connected between the second jaw 12*a* at a point spaced from handle 16 and the handle 13. The release lever 19 is disposed on a pivot 19*a* rearwardly of pivot 18 and so arranged that the forward end of the release lever is disposed under a rearward, raised portion of the toggle link 17. When the rear end of the release lever is depressed adjacent to the rear end of handle 16, the toggle link 17 is caused to be pivoted away from the handle 16 causing the spring 23 to open the jaws 12, 12*a*. From the above description of conventional parts of the locking pliers, it will be understood that squeezing the handles 13, 16 together moves the jaws 12, 12*a* toward and into engagement with one another where they are retained in locked condition by the conventional toggle mechanism described, while unlocking and separation of the jaws 12, 12*a* is achieved by simply lifting the release lever 19.

Referring now to FIGS. 2–4, wherein is illustrated the modified and improved jaws 12, 12*a* it will be seen that both of the jaws are formed of flat planar pieces of strong tough metal having curved outer edges 24, 24*a* and straight meeting edges 25, 25. The rear portions of the jaws 12, 12*a* are provided with complementary cavity 26 and projection 26*a* which enable them to turn with respect to one another about pivot rivet 14. Preferably jaw 12 at its rear is slightly thicker than the rear portion of jaw 12*a*, which is reduced at shoulders 29, and includes a pair of arcuate guides 27, 27 which preferably are straps formed as arcs of a circle having pivot 14 as its center. The guides 27, 27 have similar shaped inwardly projecting ribs 28, 28 which slide in complementary grooves 28*a*, 28*a* formed in the opposite sides of the thinner portion of jaw 12*a*. Desirably the grooves and ribs are of rounded or V-shaped cross section and the guides 27, 27 embrace the opposite sides of jaw 12*a* to keep the jaws in the same plane and proper alignment as they turn with respect to each other. Desirably the jaws and guides are so dimensioned that during turning of the jaws only the ribs and grooves contact one another so as to reduce the friction.

Each of the jaws is formed with a semi-cylindrical, threaded cavity 30 in its edge 25, forwardly of the guides 27 and grooves 28*a*. The cavities 30, 30 are drilled and tapped with threads to accommodate and fit a hanger rod of specific diameter and thread size and form, as for example a ½–13 N.C. threaded rod. The jaws may, of course, be modified or formed to fit any hanger rod and any size or style of thread. When the jaws 12, 12*a* are locked together in closed condition, as illustrated in FIG. 2, the cavities 30, 30 meet to form a cylindrical threaded recess closely fitting the particular hanger rod 31, shown in FIG. 3.

Each cavity 30 is preferably provided at each end, where it meets jaw edge 25, with an arcuate cutout 32 of small radius. When the jaws are closed, these cutouts 32, 32 meet to form unthreaded semicylindrical flutes which like the threaded recesses 30, 30 pass transversely, completely through the jaws from side to side. Thus, when the closed and locked tool is turned on the hanger rod either to dress damaged threads or to cut new threads, metal chips or cuttings will fall into the flutes 32, 32 and pass through them out of their open ends and away from the tool.

The forward ends of handles 13 and 16, rearwardly of pivots 14, 15, are offset from the plane of jaws 12, 12*a* by an acute angle 33, FIG. 3, so as to yield clearance for the hand in placing or turning the pliers with respect to objects, apparatus or material to be supported on the hanger rod 31. The pliers may obviously be inverted so as to provide the clearance either in the upward or downward direction or right or left should the hanger rod be disposed horizontally.

The use and operation of the described tool is very simple. When apparatus or material to be supported has been placed on a hanger rod, stud or bolt in approximately the desired position, the tool is applied in open condition at such position and closed in the conventional manner of locking the pliers so as to support the apparatus or material. The permanent support nut is then threaded on the hanger and "run up" to the support position of the tool. The tool is then unlocked and opened in the conventional way and removed from the hanger rod. Obviously, the same tool before application below the object to be supported may be closed and turned to dress damaged threads on the hanger rod so as to permit the permanent nut to be applied later. Alternatively, after one tool has been locked in supporting position, a second similar tool may be applied to the rod in the location of damaged threads, and turned to dress the threads. The guides 27, 27 assure proper alignment of the threads in cavities 30, 30 so that when the jaws are closed they will properly mesh with the threads of the hanger rod.

Figure 6:
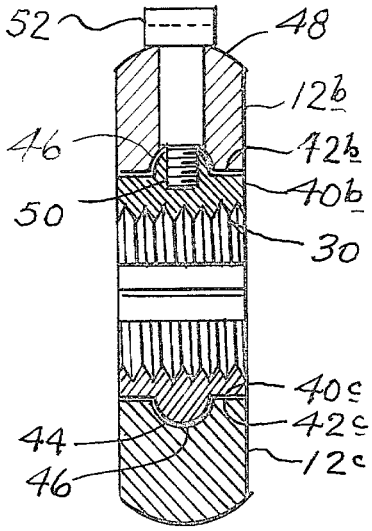
FIG. 6 is an enlarged sectional view of the tool jaws and inserts taken on line 6—6 of FIG. 5 and looking in the direction of the arrows.
Figure 7:
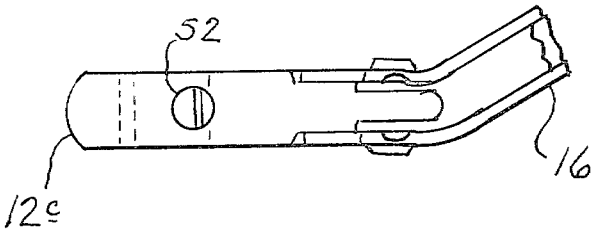
FIG. 7 is a bottom plan view of the pliers of FIG. 5.
Figure 8:
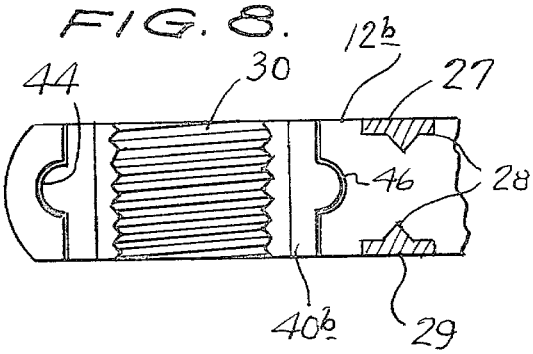
FIG. 8 is an enlarged sectional view taken along line 8—8 of FIG. 5 and looking in the direction of the arrows.
Figure 9:
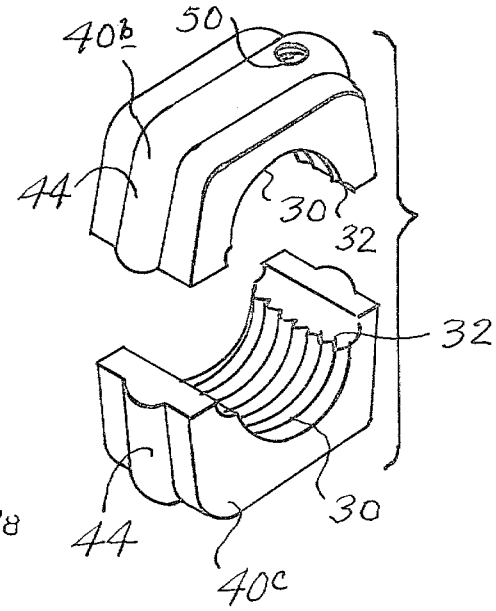
FIG. 9 is an enlarged, exploded perspective view of the adapter inserts alone.

Referring now to FIGS. 5–9, a modified version of the improved tool is shown wherein different pairs of adapter inserts may be secured in the jaws to adapt the pliers to grip hanger rods of different size or having different thread form. As best seen in FIG. 9, a pair of inserts 40*b*, 40*c*, each being of generally rectangular shape and of approximately the same thickness as the jaws 12*b*, 12*c*, FIG. 6, are secured in closely fitting recesses 42*b*, 42*c* in the jaws respectively. Each insert is provided with a semi-cylindrical threaded cavity 30 and the flutes 32 in one side of the insert, so that when the plier jaws are closed these sides will meet and the resultant cylindrical threaded cavity 30, 30 will fit a desired hanger rod and thread form. Different pairs of inserts 40*b*, 40*c* may obviously be provided for hanger rods of different size and different thread form.

The other three sides of each insert 40*b*, 40*c* are formed with a continuous central projecting rib 44 which seats in a complementary groove 46 in the jaw 12*b* or 12*c*. The ribs and grooves assure proper alignment of the pair of inserts and their threads, and also bear the tension or compression of the load when the pliers grip a hanger rod. While the ribs 44 and seating grooves 46 have been shown as semi-cylindrical in cross section, other shapes that lend themselves to economical production may be used. The corners of the inserts 40*b*, 40*c*, where the said three sides meet, are preferably slightly rounded and form slightly obtuse angles, as shown, and this is also true of the closely fitting recesses 42*b* and 42*c*, so that the adapters 40*b* and 40*c* may be quickly inserted into or released from the jaws 12*b*, 12*c*.

Screws 52, 52 are fasteners for securing the inserts 40*b*, 40*c* firmly in place in the jaws. To this purpose, the threaded end portion of screw 52 engages in a threaded hole 50 in the insert, while the outer shank portion of screw 52 is inserted through a clearance hole 48, FIG. 6, in the respective jaw 12*b* or 12*c*. As shown in FIG. 5, the two insert fastener screws 52 are aligned on one side of the diametric center line of the threaded cavity 30. However, the screws 52, 52 are centered transversely of the plier jaws so that a pair of inserts 40*b*, 40*c* can only be fastened in the pliers in the one proper way when holes 48 and 50 align with each other. The user can, therefore, disregard right, left, top or bottom when placing the adapter inserts in the jaws so long as the mentioned holes align.

It will be obvious that once the pliers of FIGS. 5–9 are fitted with the appropriate pair of adapter inserts for the hanger rod desired, the pliers are used and operated in the same manner as has been previously described in connection with the embodiment of FIGS. 1–4.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. Locking pliers for gripping threaded hanger rods, or the like, to temporarily support apparatus thereon at a desired level, comprising a pair of enlongated handles, a pair of jaws aligned with said handles in extension thereof, pivot means connecting the jaws to the handles for turning movements to spread opposing jaw surfaces apart to open condition and to turn the said jaw surfaces against each other to closed condition, toggle link means for locking said jaw surfaces in closed condition, and a threaded cavity in each of said surfaces extending entirely across each jaw transversely thereof, the said cavities being aligned with each other and being so formed that in closed and locked condition of the jaws they together define a cylindrical recess having standard screw threads capable of gripping the complementary threads of the hanger rod and temporarily supporting apparatus thereon and alternatively permitting rotation of the locked pliers about the hanger rod to threadedly move the pliers up or down the rod for changing the support level, one of said jaws being provided with a pair of guides fixed thereto and extending over and embracing the second jaw so as to hold the two jaws aligned in the same plane during their movement to closed position.

2. Locking pliers as set forth in claim 1, wherein each of said guides is provided with a rib extending longitudinally of the guide, and each side of said second jaw is provided with a complementary groove which slideably receives and seats the adjacent one of said ribs.

3. Locking pliers as set forth in claim 2, wherein said guides, ribs and grooves are formed as arcs of circles centered about a pivot of said pivot means so as to guide the jaws to turn with respect to one another about the said pivot.

4. Locking pliers as set forth in claim 3, wherein each of said ribs and grooves is substantially V-shaped in cross section, and only the ribs and grooves are in contact when the pair of jaws are moving to open or closed condition, whereby to reduce the friction during such movements.

* * * * *